United States Patent [19]

Buckley

[11] 4,100,006

[45] Jul. 11, 1978

[54] CARD-CLOTHING

[75] Inventor: John Buckley, Oldham, England

[73] Assignee: The English Card Clothing Company Limited, Huddersfield, England

[21] Appl. No.: 780,902

[22] Filed: Mar. 24, 1977

[30] Foreign Application Priority Data

Apr. 6, 1976 [GB] United Kingdom ..... 13798/76
Sep. 18, 1976 [GB] United Kingdom ..... 38754/76

[51] Int. Cl.[2] ..... B32B 5/20

[52] U.S. Cl. ..... 156/78; 19/114; 156/91; 156/250; 264/46.4; 264/50; 428/311

[58] Field of Search ..... 156/78, 79, 250, 91; 19/114; 428/310, 311; 264/46.4, 50

[56] References Cited

U.S. PATENT DOCUMENTS

| | | | |
|---|---|---|---|
| 3,290,729 | 12/1966 | Marnard | 19/114 |
| 3,562,043 | 2/1971 | Eddy | 156/79 |
| 3,637,456 | 1/1972 | Mao | 428/310 |
| 3,713,868 | 1/1973 | Gordon | 428/310 |
| 3,947,922 | 4/1976 | Ibbotson | 19/114 |
| 3,949,123 | 4/1976 | Steel | 428/311 |

*Primary Examiner*—Edward G. Whitby
*Attorney, Agent, or Firm*—Norris & Bateman

[57] ABSTRACT

A method of manufacturing flexible card-clothing for use in textile carding comprising the steps of producing a foamed polyvinylchloride compound having a density of between 0.6 and 1.00 grams per cubic centimeter; applying a sealing coat of a material which is compatible with the foamed compound to a fabric layer; applying a layer of the foamed p.v.c. onto the seaing coat to produce a finished foam layer of between 2 and 5 millimeters thickness on the fabric; heating the applied foamed layer to p.v.c. to cause the foamed layer to fuse; applying a surface layer of sealing material onto the exposed surface of the foamed layer to provide a smooth non-absorbent external surface, with the fabric, foamed p.v.c and surface layer together forming a composite foundation face, combining the foundation face with a foundation back to form a laminated foundation, and then inserting card-clothing wires into the foundation so that parts of the wires project from the surface layer.

7 Claims, 1 Drawing Figure

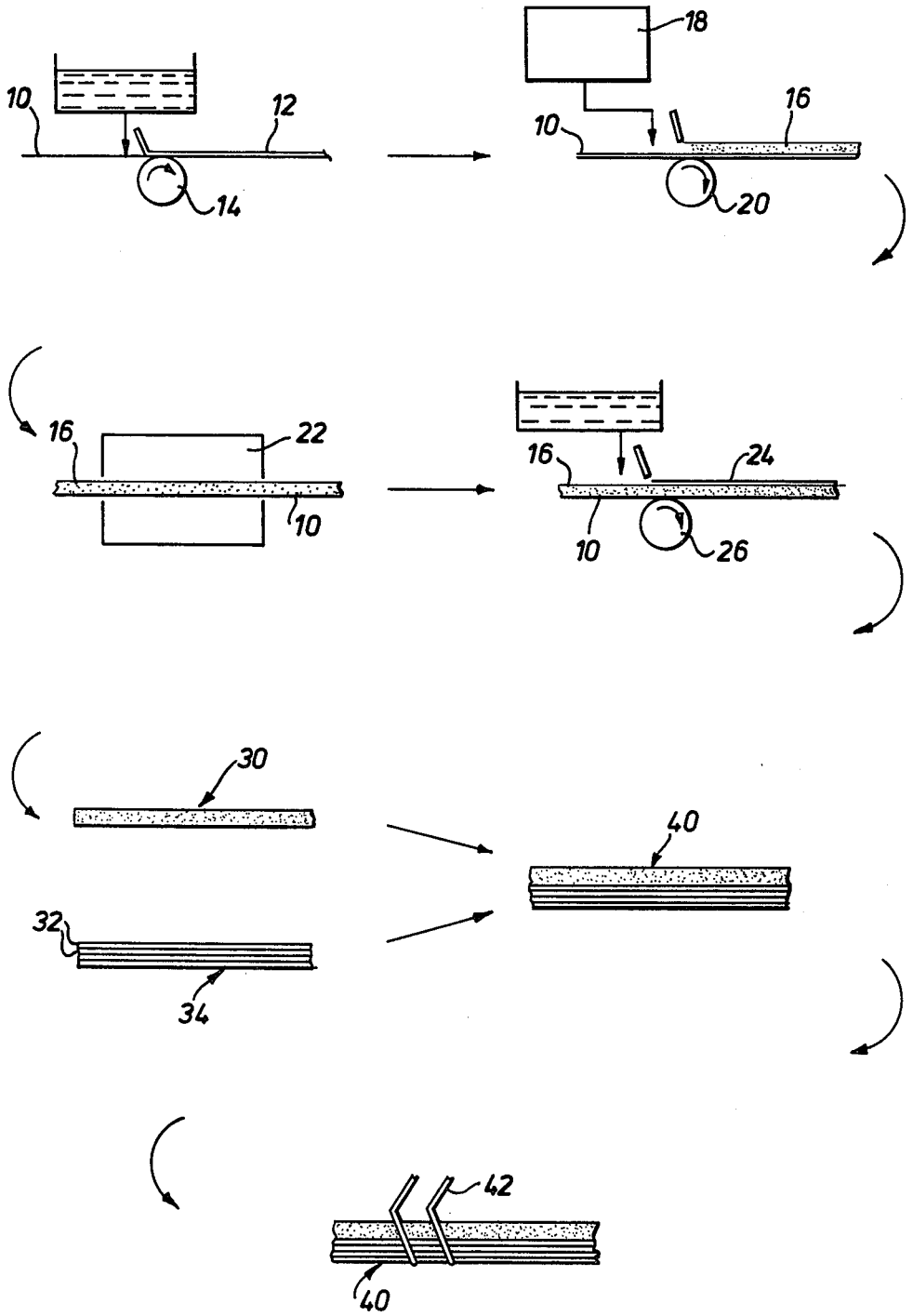
10
12
14
18
16
10
20
16
22
10
16
24
10
26
30
40
32
34
42
40

CARD-CLOTHING

Flexible wire type card-clothing comprises a foundation in which the wires are supported, and traditionally, the foundation has been made of a plurality of layers of woven fabrics, bonded together by natural rubber adhesive. For any particular card-clothing application, there is a minimum desirable thickness of the foundation, determined by the necessity to provide adequate support for the wires. If the thickness is achieved simply by building up layers of woven fabric, this can be very expensive, and special foundations have been produced, in which the thickness is achieved partly by a layer of felt, cork, rubber or synthetic rubber such as nitrile rubber.

Use of these special layers has its own problems, some of which have never been satisfactorily overcome. For instance cork varies in density and the hardness of its constituent chips. Sometimes a hard piece of bark in the cork is encountered by the pricker blades in the wire setting machine, and this has two deleterious consequences — first the pricker blades themselves become blunt, and second a relatively poor "setting picture" is obtained. The "setting picture" is the distribution of the wire tips in the completed card-clothing, as seen on visual inspection, and the more consistent this pattern, the better will be the carding action. Also, hard patches in the cork layer tend to deflect the wires so that again the setting picture is adversely effected. Furthermore, wires which are adjacent to hard patches of the cork will have a different "recovery rate" than other wires and this reduces the evenness of the carding process. "Recovery rate" is the measurement of the tendency of the wire to return to its original angle of inclination after being subjected to bending.

A similar set of problems arise if a layer of nitrile rubber is incorporated in the foundation. The rubber will have a filler (usually textile waste material) and this may include hard pieces or even pieces of metal. These inconsistencies in the filler produce a layer of varying resistance to penetration by the pricker blades and the wires. There is also a tendency for parts of the nitrile layer to flake off and this again has an adverse effect on the setting picture.

According to the invention a method of manufacturing flexible card-clothing for use in textile carding comprises the steps of:

mechanically introducing air into a polyvinylchloride (p.v.c.) compound, which is in a plastisol form, in a continuous foam mixer to produce a foamed compound having a density of between 0.6 and 1.00 grams per cubic centimeter; applying a sealing coat of a material which is compatible with the foamed material to a fabric layer, said sealing coat being adequate to prevent substantial penetration of said fabric layer by said foamed material; applying a layer of said foamed p.v.c. onto said sealing coat to produce a finished foam layer of between 2 and 5 millimeters thickness; heating said foamed layer of p.v.c. to cause said foamed layer to fuse; applying a surface layer of sealing material to the exposed surface of said foamed layer, to provide a smooth non-absorbent surface, so that said fabric, said foamed p.v.c. and said surface layer together form a composite foundation face; combining said face with a foundation back to form a laminated foundation, and then inserting cardclothing wires into said foundation so that parts of said wires project from said surface layer. The expression "polyvinylchloride compoound" is intended to include copolymers of polyvinylchloride whenever used in this specification. The back provides part of the thickness of the finished foundation and may for instance take the form of a series of layers of woven fabric bonded to each other as in conventional card-clothing foundations.

In the known method of producing card-clothing which includes a sponge layer of polymeric material such as nitrile rubber, a blowing agent is incorporated in the liquid material, so that the sponge is chemically produced. In contradistinction to this, the card clothing foundation of the invention is produced by a mechanical method which includes mixing air with the p.v.c. to create foamed material, before that material is actually applied to the fabric layer. In this manner, it has been found possible to exercise the necessary close control over the thickness, density and structure of the foamed layer, which is a desideratum peculiar to card-clothing foundation, in order to reduce or avoid the problems associated with the known foundation manufacturing methods as set out above.

The foundation constructed as described above has been found to give the required support to the wires whilst at the same time permitting the necessary flexing of the foundation and ready penetration by the pricker blades.

By using the foamed layer, it is possible to reduce the cost of producing card-clothing foundation (and therefore the card-clothing itself) as compared with the production of foundation of the kind previously referred to which incorporates a layer of sponge nitrile rubber. At the same time, it has been discovered that if the density of the foam layer is within the preferred range, and the surface layer is provided, the foundation will give a firm support to the teeth and will produce a better "setting picture" than that obtained with the known foundations.

It has been found that ordinary unfoamed p.v.c. or p.v.c. copolymer or polyurethane is suitable for the purpose of the surface layer, but the invention is not restricted to the use of these materials, since any polymeric material which gives the required surface finish and is compatible with the foamed layer, to which it must adhere, will suffice. The surface layer may include silicones as described in the specification of U.S. Pat. No. 3,947,922 for the purpose of improving the release properties.

The thickness of the surface layer effects the support of the wires and will be chosen according to the type of wires which are to be inserted. Preferably the thickness of this layer lies within the range 0.1 to 1.00 millimeters. A preferred foundation useful with a variety of wires as used on the breasts, workers and strippers of a woollen carding machine has a surface layer approximately 0.2 millimeters thick.

Suitable materials for the sealing coat are p.v.c. latex, nitrile latex, or a p.v.c. plasticiser system.

One form of card-clothing in accordance with the invention, and its method of manufacture, will now be described by way of example only, with reference to the accompanying FIGURE which illustrates a series of steps in the manufacture of the card-clothing.

First, a layer of fabric 10, which may conveniently be a woven cotton such as those used in the manufacture of card-clothing foundation is treated by applying to its upper surface a sealing coat 12 of p.v.c. latex. In the drawing the latex is shown as being applied by a knife-over-roller arrangement 14, on to the fabric 10, but it is to be understood that this is purely diagrammatic and that the sealing coat may be applied in any convenient manner. The sealing coat 12 penetrates the fabric to some extent, and ensures that foamed material cannot penetrate the fabric.

A p.v.c. foam 16 is produced mechanically by aeration of a p.v.c./plasticiser system in a continuous foam mixer 18. The foamed material produced by this method has a density of approximately 0.75 to 0.80 grammes per cubic centimeter and because of the nature of the production technique, the foamed material has an open cell structure. Of course, a percentage of the cells will be closed, but predominently, the cellular structure is opened, and this has been proved by tests, which show that the material is completely absorbent.

The prefoamed p.v.c. 16 is applied to the sealed surface of the fabric 10 by mechanical application, such as by a knife-over-roller arrangement, indicated diagrammatically at 20. The foamed p.v.c. layer which is applied in this manner should be between 2 and 5 millimeters in thickness, and in a specific example, is approximately 3 millimeters thick.

The foamed p.v.c. layer is then fused, for example, by passing it through an oven 22, and then a surface layer 24 (say 0.2 millimeters thick) of non-foamed p.v.c. is applied to the exposed top surface of the foamed layer 16 to provide a smooth sealed surface for the face. The non-foamed layer of p.v.c. will of course bond quite easily to the foamed p.v.c., and at the same time, it has the effect of closing the cavities in the top surface of the foamed layer. In the drawing the surface layer is shown being applied on to the foamed layer by a knife-over-roller arrangement 26, but again this is purely diagrammatic, and any known method of application may be used.

There is thus produced a card-clothing face 30 comprising a lamination of fabric 10, foamed p.v.c. 16 and surface layer 24.

A series of four layers 32 of woven cotton or linen of the kind conventionally used in the manufacture of card-clothing foundation is prepared in known manner, and the layers of woven fabric are bonded together by utilisation of a natural rubber adhesive which is applied to the fabric layers. In this manner a fabric back 34 is produced, and if there are say four layers of woven fabric each about 0.5 millimeters thick, the resulting back is a little over 2 millimeters in thickness. This of course is not rigid enough to provide adequate support for the card-clothing wires.

The face 30 and back 34 are then brought together after their meeting surfaces have been treated with one or more layers of a suitable adhesive compatible with the bonded fabric back and the foamed p.v.c. 16, so that the face adheres to the back to form the complete foundation 40.

Finally, the foundation 40 is punched, and card-clothing wires 42 in the form of the conventional staples are fitted through the punched holes in the conventional manner.

Card-clothing manufactured in this way, is quite as effective as the known types of card-clothing comprising fabric backing with a rubber or nitrile rubber layer, and in particular it provides a firm but sufficiently resilient anchorage for the card-clothing wires. It also has a good setting picture, and the surface layer 24 of the foundation does not easily hold lint or other contaminating material. Moreover, the card-clothing has good flexing properties, making it suitable for use as fillet, which has to be wound in convolutions around a roller of a carding machine. In addition, the manufacturing technique is particularly suited to the production of long unjoined pieces of foundation, which are desirable for use on the increasingly popular wide carding machine.

I claim:

1. A method of manufacturing flexible card-clothing for use in textile carding comprising the steps of:

mechanically introducing air into a polyvinylchloride (p.v.c.) compound, which is in a plastisol form, in a continuous foam mixer to produce a foamed compound having a density of between 0.6 and 1.00 grams per cubic centimeter; applying a sealing coat of a material which is compatible with said foamed compound to a fabric layer; applying a layer of said foamed p.v.c. onto said sealing coat to produce a finished foam layer of between 2 and 5 millimeters thickness on said fabric, said sealing coat being adequate to prevent substantial penetration of said fabric layer by said foamed material; heating said applied foamed layer of p.v.c. to cause said foamed layer to fuse; applying a surface layer of sealing material to the exposed surface of said foamed layer to provide a smooth non-absorbent external surface therein, said fabric, foamed p.v.c. and said surface layer together forming a composite foundation face; combining said foundation face with a foundation back to form a laminated foundation and then inserting card-clothing wires into said foundation so that parts of said wires project from the smooth external surface of said surface layer.

2. A method of manufacturing flexible card-clothing according to claim 1, wherein said layer of foamed material has a density of between 0.75 and 0.80 grammes per cubic centimeter.

3. A method of manufacturing flexible card-clothing according to claim 1, wherein said surface layer comprises one of unfoamed p.v.c.; p.v.c. copolymer and unfoamed polyurethane.

4. A method of manufacturing flexible card-clothing according to claim 1, wherein said surface layer includes a silicone.

5. A method of manufacturing flexible card-clothing according to claim 1, wherein the thickness of said surface layer lies within the range 0.1 to 1.0 millimeters.

6. A method of manufacturing flexible card-clothing according to claim 5, wherein the thickness of said surface layer is approximately 0.2 millimeters.

7. A method of manufacturing flexible card-clothing according to claim 1, wherein said sealing coat comprises one of p.v.c. latex; nitrile latex; and a p.v.c. plasticiser system.

* * * * *